US005201102A

United States Patent [19]

McClure

[11] Patent Number: 5,201,102

[45] Date of Patent: Apr. 13, 1993

[54] CASKET BED SYSTEM

[76] Inventor: Wilbur F. McClure, 415 S. Plum St., Troy, Ohio 45373

[21] Appl. No.: 740,939

[22] Filed: Aug. 6, 1991

[51] Int. Cl.[5] ..... A61G 17/00

[52] U.S. Cl. ..... 27/12; 27/13; 5/453

[58] Field of Search ..... 27/12, 13, 2; 5/435, 5/632, 646–648, 453

[56] References Cited

U.S. PATENT DOCUMENTS 2,099,977 11/1937 Harris ..... 27/13 X
2,859,505 11/1958 Jarvis ..... 5/455
4,424,599 1/1984 Hannouche ..... 5/632
4,694,520 9/1987 Paul et al. ..... 5/455 X
4,949,412 8/1990 Goode ..... 5/455 X
4,986,738 1/1991 Kawasaki et al. ..... 5/455 X
5,020,168 1/1991 Wood ..... 5/455 X
5,103,519 8/1992 Hasty ..... 5/453

*Primary Examiner*—Richard E. Chilcot, Jr.
*Attorney, Agent, or Firm*—William Weigl

[57] ABSTRACT

A casket bed system comprises an air mattress having a plurality of independently inflatable sections to enable a corpse to be positioned for mourner viewing. The head of the corpse may be vertically adjusted relatively to the foot level, the upper torso may be angularly tilted slightly toward the viewing side of the casket and the head may be adjusted relative to the chest to properly space the chin from the chest to provide a natural, restful appearance.

18 Claims, 2 Drawing Sheets

FIG. 1
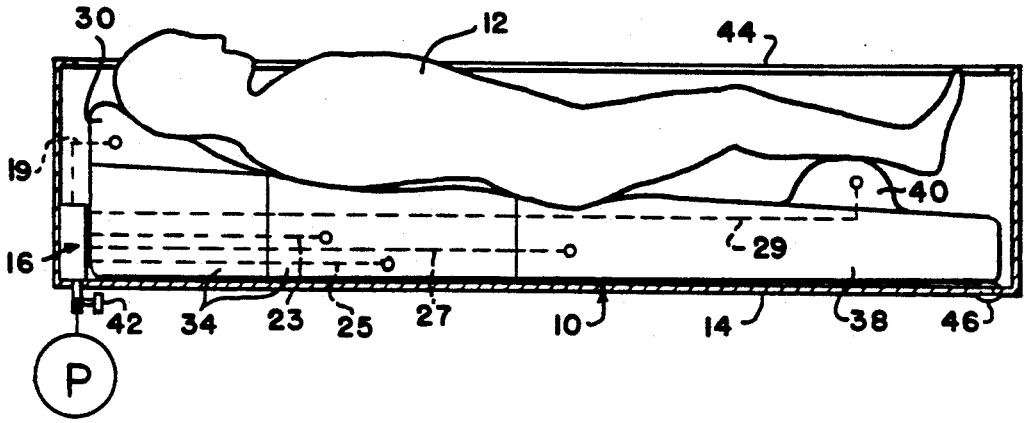
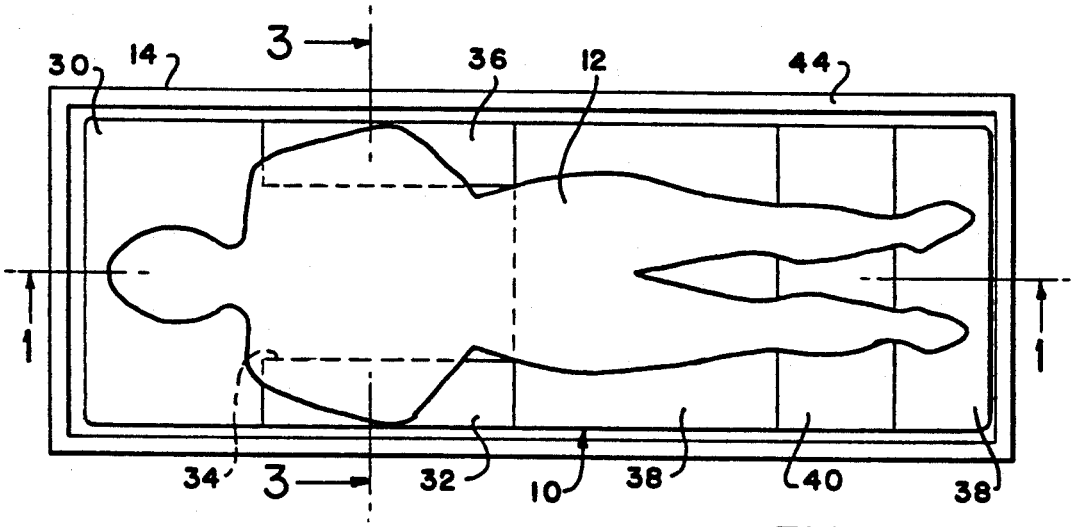
FIG. 2
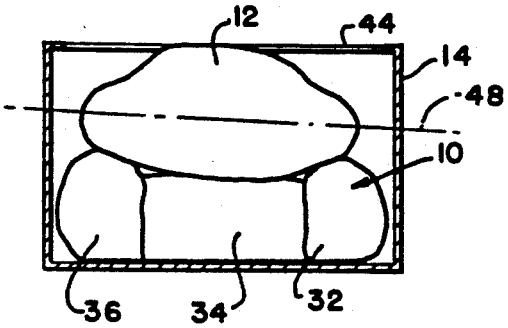
FIG. 3

CASKET BED SYSTEM

This invention relates to a bed system for supporting a corpse in a casket, and in particular to an inflatable air mattress capable of having its upper surface adjusted vertically and/or angularly to position the corpse at a first level and/or angle during viewing and for lowering it to a second level at casket closing for burial.

BACKGROUND OF THE INVENTION

The common bed system in known caskets consists of a flat metal frame and spring system, with crank means being provided at each end of the frame for vertically raising and lowering the frame and corpse. The end adjustments are separately operable so that the corpse may be inclined downwardly in the casket from head to toe during viewing by mourners. It is common practice at some funeral parlors for the body to be angled downwardly at perhaps three degrees or so, with the face of the deceased being above the top level of the base of the casket and the toes or shoe tips being approximately at the top level of the base. While body placement varies somewhat from one funeral parlor to the next, the face forward of the ears is usually viewable from the side from across a room. In addition to a portion of the head level being above the base, the body is frequently tilted angularly a small amount, particularly the upper torso, so that the body faces slightly toward the viewing side of the casket. Some higher-priced caskets are known to have an auxiliary mechanism associated with the crank means to enable the bed frame to be so tilted.

Although the separate end adjustments of the conventional frame in moderate and lower-priced caskets can readily provide the desired head-to-toe angle, they cannot accommodate the angular torso tilting. It is also believed that none of them in any price range can accommodate another desirable feature, i.e., placing the chin relative to the chest so that the face has a natural, restful reclining appearance in relation to the rest of the body. These are ordinarily compensated for by selectively placing cushions, cotton stuffing, plastic bottles, folds of cardboard or other objects under the upper torso and head in order to prop the torso and head to the desired viewing positions. This is not known to the general public, some of which would find it objectional.

SUMMARY OF THE INVENTION

This invention provides a casket bed system which enables making all of the usual body adjustments from a single source, using air to selectively inflate and deflate independent sections of an air mattress. Not only is the system capable of easier and quicker adjustment without requiring the use of auxiliary items for body propping, it does so with a relatively inexpensive structure. Once the body is placed on the casket bed, all adjustments can be made without manual lifting of the body by one person while another locates a propping device in a selected location. Thus, a single individual can adjust the various body and head positions, avoiding the necessity to require assistance. The bed system of the invention is also light in weight, somewhat reducing the burden for carrying by pallbearers.

It is a primary object of this invention to provide an elongated air mattress having independently adjustable sections for selectively positioning a corpse in a casket, both for viewing and for subsequent burial.

A more specific object is to enable the upper torso of a deceased person on display for viewing by mourners to be angularly adjusted toward the viewers by relatively controlling the amount of air in independently inflatable and deflatable side sections of the mattress.

Still another object is to adjust an air pillow on which the head of the corpse rests so as to place the deceased's chin in a normal reclining position relative to the chest.

Other objects and advantages will become apparent from the following description, in which reference is made to the accompanying drawings.

IN THE DRAWINGS

FIG. 1 is a cross-sectional view taken substantially along lines 1—1 of FIG. 2, showing the outline of a corpse lying on a bed system constructed according to my invention.

FIG. 2 is a plan view taken looking from above FIG. 1.

FIG. 3 is a horizontal sectional view looking in the direction of lines 3—3 of FIG. 2, illustrating an angular tilt of the upper torso of the corpse, which is one of several primary features of my invention.

DETAILED DESCRIPTION OF THE INVENTION

A bed system according to a preferred form of the invention includes a mattress 10 for supporting a corpse 12 in a casket base 14. The mattress 10 can be made of any flexible, air-impervious material such as is commonly used for air mattresses and water flotation gear. Heat-sealable polyvinyl chloride sheet material is but one example. The thickness gauge and method of producing the mattress 10 should be such as to give adequate body support without risk of puncture for the period of use prior to burial. Since the actual details of construction and methods of making air mattresses are well known, they will not be discussed herein. While I prefer for the sake af simplicity, cost and handling to make the mattress 10 as a unitary structure, it is within the scope of my invention to make the sections separable, as will be obvious once the invention is completely understood.

Figure 5:
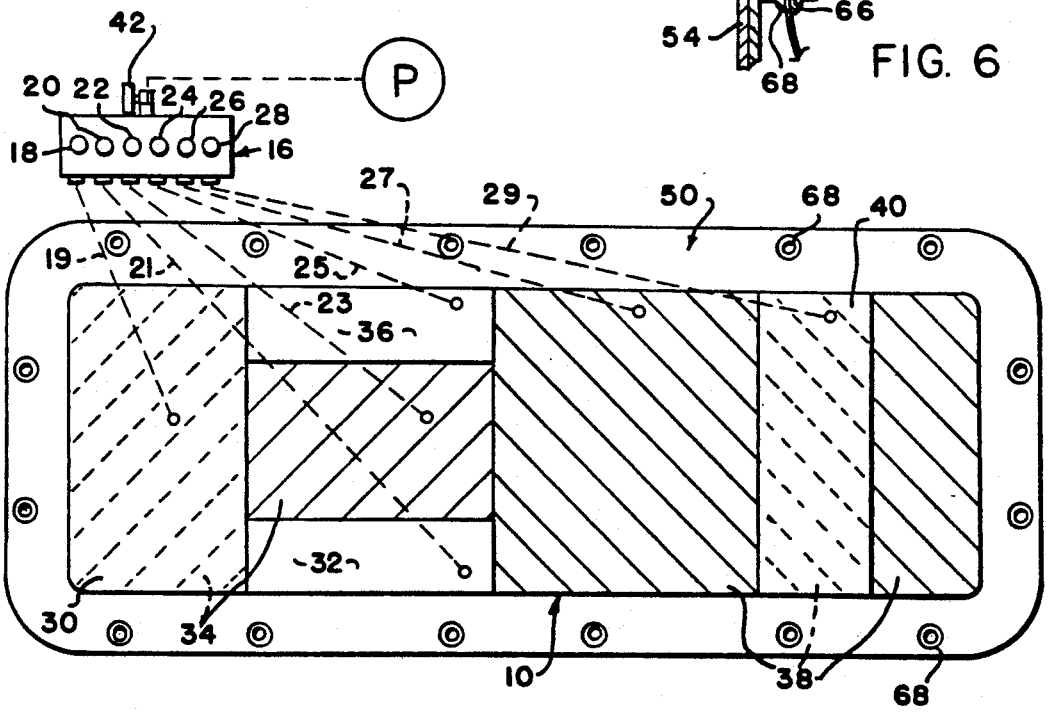
FIG. 5 is a simplified plan view of an integral mattress and hammock, illustrating a preferred arrangement of inflatable/deflatable sections and controls therefor.

The mattress 10 is inflatable by means of a pump P (FIGS. 1 and 5). The pump P can be motorized or operated manually. For convenience, ease and speed of operation, an electrically-operated pump is preferable. Its original cost is insignificant, since it is attached, used, disconnected before burial and used over and over again. The pump P is connected to a manifold 16 below the base 14 of the casket. The manifold is intended, under normal circumstances, to be placed within the casket and buried along with the deceased. The manifold can be of conventional construction, having individual valves (not shown) which can be manually controlled by knobs to admit introduction of pressurized air, hold the air in the sections and bleed the air to deflate the sections, all as required to meet the specific needs of a given situation. The manifold 16 is shown as having a series of dotted lines extending therefrom to indicate connections between the manifold and various ones of the sections of the mattress about to be described.

Figure 4:
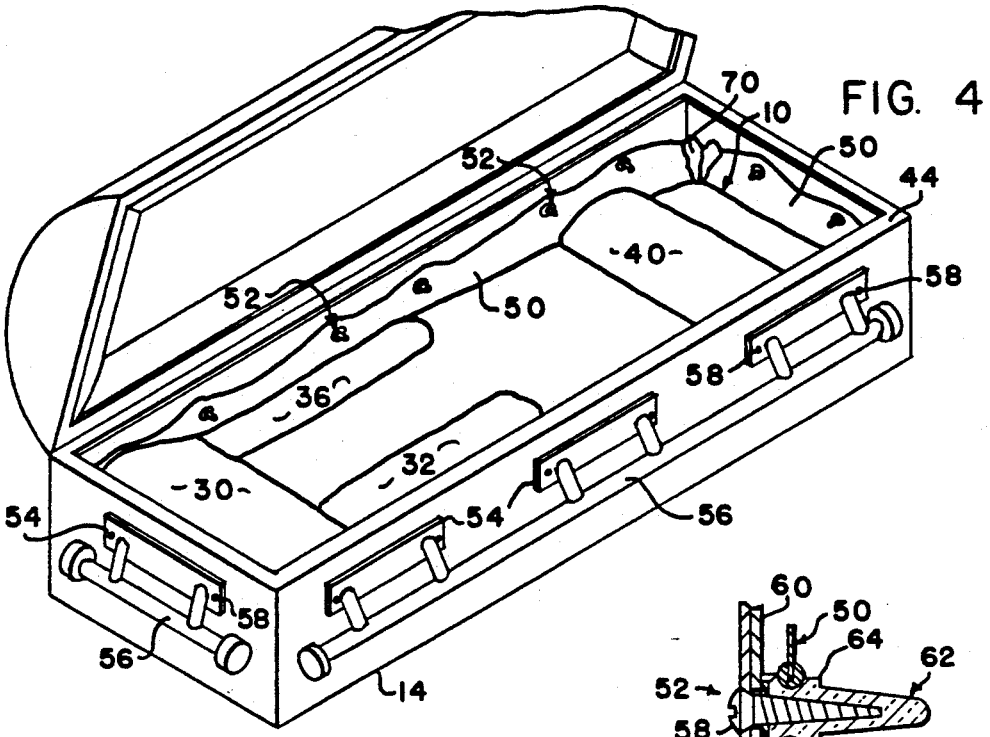
FIG. 4 is an isometric view of an alternative form of my casket bed system, wherein the mattress is supported on, and is preferably integral with, a hammock supported on the inside walls of the casket base.

Although the individual sections of the mattress may take different forms to meet the individual preferences of a funeral director, I have illustrated only one form of mattress in both bed system embodiments shown in FIGS. 1 and 4. For this reason, and in order to better understand the description of the mattress in relation to the corpse in FIGS. 1-3, let us cross refer to FIGS. 1 and 5, where the vertical and horizontal mattress sections are most simply depicted. Knobs 18, 20, 22, 24, 26 and 28 of manifold 16 (FIG. 5) are operatively connected to air lines 19, 21, 23, 25, 27 and 29 respectively. Air line 19 feeds a head pillow section 30, line 21 a right side torso pillow 32, line 23 a lower chamber 34 for the upper torso, line 25 a left side torso pillow section 36, line 27 a lower chamber 38 for the lower part of the body and line 29 feeds a foot or leg pillow section 40. Chamber 34 is substantially T-shaped horizontally, as shown by the cross-hatching angled upwardly to the right in FIG. 5. The dotted hatching represents that portion of chamber 34 which is below and separate from the head pillow 30. Similarly, chamber 38 is shown as being cross-hatched upwardly to the left, with that portion of the chamber 38 underlying the leg pillow 40 being in dotted lines hatching. Each of the knobs 18, 20, 22, 24, 26 and 28, as well as a knob 42 for air pump P, control the inlet, retention and outlet of air with respect to the sections to which they and their respective air lines are connected.

Referring back to FIG. 1, the base 14 has a top or upper level 44 which helps form part of a sealing surface with a hinged lid or cap which closes the casket at time for burial. The lid is open as shown in FIG. 4 during viewing. For viewing during visitation by mourners, the body 12 is normally raised as shown, with the face of the deceased above the level 44 and ordinarily with the upper torso tilted very slightly toward viewers. The foot or toe level is customarily below or approximately at the level 44. In FIG. 1, it will be noticed that the mattress 10 is tapered downwardly from the head end to the foot end. The taper inclines the body perhaps about three degrees when chambers 34 and 38 are equally pressurized. This angle, and whether or not the mattress is tapered is a matter of personal preference. Many funeral directors prefer to have the face at a level where at least part of an ear is visible by a person standing across the room.

The side from which a body is viewed is a matter of personal preference, sometimes dictated by the cause of death. As shown in FIG. 1, the head is at the left end, and the manifold 16 is adjacent the head end. If desired, the head could be placed at the right end of the base, and the manifold either remaining at the left end of the casket or located at the right. To enable this, a plug 46 can be removed from below the base and the manifold mounted to extend through the unplugged opening. The location of the manifold is immaterial, just so long as it can be easily reached manually from the open top of the casket at any time the knobs are to be operated. Obviously, when the casket is ready for its final closing, the knobs are operated to bleed air from the appropriate sections of the mattress to lower the body below the upper level 44 so as to enable easy closing of the lid.

The position of the leg pillow 40 on the mattress is designed to accommodate either a tall or short person. Thus, the pillow 40 may be beneath the calf of one person while beneath the ankle or heel of another. The head pillow 30 is preferably inclined to assist in positioning the head so that the chin of the deceased is spaced from the chest to provide a natural reclining pose, rather than one in which the head appears to lay back too far or the chin appears to crowd the chest. The head pillow achieves both the chin positioning as well as raising the head level to the proper height above the base.

FIG. 3 illustrates how the angular tilt of the body can be achieved. Ordinarily, it is only the upper torso, i.e., from the waist up, that is tilted if tilting is to be done at all. The teaching of my invention could allow for angular tilting of the entire body, if desired, by extending pillows 32 and 36 toward the foot end of the mattress. Tilting is achieved by selectively inflating and deflating the two torso pillows 32 and 36. It can be seen that pillow 36 is inflated more than pillow 32, resulting in an angular tilt toward the right as viewed in FIG. 3 by the exaggerated dot-dash lin3 48. The difference in inflation can be the result of bleeding air from pillow 32 or adding air to pillow 36. In preparation of the body for viewing, I prefer to first fully inflate all of the independent sections and chambers and then to selectively bleed air to achieve the desired results. The technique employed, however, depends on what the director finds most convenient. Regardless which approach is used, my invention enables one person to do the entire task by himself. Everything can be accomplished by appropriately manipulating the manifold knobs and operating the air pump by one's self, without assistance from a second person.

Figure 6:
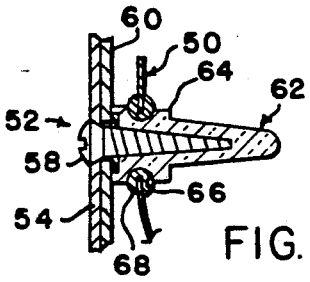
FIG. 6 is a detailed vertical fragmentary view of one of the supports for hanging the hammock of FIGS. 4 and 5.

Referring now to an alternative embodiment of my invention illustrated in FIGS. 4-6, the primary difference is in the fact that the mattress is supported in a hammock 50 at both sides and both ends of the internal walls of the base. Preferably in this variation, the mattress 10 and hammock 50 are integral, with the hammock being the lower side of the mattress. The support is provided by attaching means 52 which are already found in conventional caskets. Escutcheons 54 are mounted on the outer side and end walls of the base 14, and in turn, the escutcheons and attaching means support conventional carrying handles 56 gripped by pallbearers while transporting the casket manually.

As seen in FIG. 6, the escutcheons 54 are fastened by means of screws 58 which pass through holes in a base wall 60. The threaded caps or nuts 62 for screws 58 are molded of thermoplastic material and have a hex-headed portion 64 for tightening purposes. A modification has been made in the conventional nut by circumferentially grooving it at 66 to enable grommets 68 in the peripheral edge of the hammock 50 to hang from the grooved nuts. This is illustrated in FIGS. 4 and 6. Since the hammock is shown in its flat condition in FIG. 5, gussets 70 will appear at the corners of the hammock when it is suspended from the nuts 62, as in FIG. 4.

The construction of the mattress, its manner of support in the base and whether the various sections of the mattress are integral or separate are matters of choice. In addition, some of the independent sections may be combined, e.g., the lower chamber 38 and foot pillow 40 may be made into a single air section. Various other changes may be made in the details of construction without departing from the spirit and scope of my invention.

Having described my invention, I claim:

1. A bed system for adjustably supporting the corpse of a human body in a casket having a base including a bottom wall and pairs of opposed end and side walls, said bed system comprising:

an elongated air mattress having a head end and a foot end and being of a horizontal length and width to support said corpse, said mattress having a plurality of independently inflatable and deflatable sections for vertically varying either: a) the head level of said body relative to the foot level, b) one side level of at least the upper torso of the corpse relative to the other side whereby at least the upper torso may be tilted angularly toward a mourner-viewing side of the casket or c) both of said levels, and valve means for each of said sections for independently controlling the volume of air contained therein in accordance with the desired adjusted head level and body tilt.

2. The bed system according to claim 1 wherein the section for adjusting the head level comprises a pillow, and wherein the volume of air contained in said pillow can control the relationship of the corpse's chin relative to its chest so as to create a natural, restful appearance.

3. The bed system according to claim 1 wherein said mattress is downwardly-tapered lengthwise toward the foot end.

4. The bed system according to claim 1 wherein a hammock is supported on the side and end walls and wherein said bed system is supported on said hammock.

5. The bed system according to claim 4 wherein said base is provided with carrying handles exteriorly of the side and end walls, wherein the handles are attached to said walls by fastening means extending interiorly through the walls, and wherein said hammock is suspended from said fastening means.

6. The bed system according to claim 4 wherein the hammock comprises the lower side of said air mattress, whereby said hammock and mattress are integral.

7. The bed system according to claim 5 wherein the periphery of said hammock is provided with a plurality of grommets for suspending the hammock from the fastening means.

8. In a body-supporting bed system for use in a casket having a base consisting of a bottom wall, a pair of side walls and a pair of end walls of dimensions to receive a corpse for burial, an elongated air mattress comprising:

a) a head pillow section, b) a left side section for supporting the upper torso of a corpse, c) a right side section for supporting the upper torso portion of a corpse, each of said mattress sections being independently inflatable and deflatable, and each section being provided with valve means for allowing introduction of air into or bleeding of air from its respective section, whereby the upper torso of said corpse may be vertically adjusted for tilting the body angularly toward viewers and the head pillow may be adjusted for raising the head above the level of the remainder of the body during viewing.

9. A bed system according to claim 8 further including a manifold for all of said valve means for controlling inflation and deflation of said air mattress from a single location within the casket.

10. A bed system according to claim 9 wherein said manifold includes means for connecting the valve means to a supply of air under pressure.

11. A bed system according to claim 8 wherein said base has a plurality of horizontal handles at the exterior of said side and end walls for hand-carrying of said casket, said handles being supported on the casket by fasteners comprising inwardly-extending threaded members having attaching nuts at the interior of said walls, and a hammock suspended from said attaching nuts and supporting the mattress within the base.

12. An elongated air mattress for supporting a corpse in a casket base and for vertically relatively adjusting the upper side torso portions of the corpse for angularly tilting the body toward viewers, said mattress being of a length and width to accommodate the corpse for both viewing and burial, a plurality of inflatable/deflatable elongated sections extending longitudinally of said mattress at least for the length of the upper torso, means for supplying air to each of said sections, and valve means for each of said sections, said valve means including means for bleeding air from each respective section to adjustably vary the volume of air contained therein, said sections being independently inflatable and deflatable whereby the upper torso of the corpse may be adjusted vertically to different levels for said angular tilting.

13. An air mattress according to claim 12 further including a head pillow section which is independently inflatable and deflatable relative to the side sections for vertically adjusting the head level relative to the remainder of the corpse, and valve means for said head pillow section, said head pillow section being constructed to adjust spacing of the chin of the corpse relative to its chest.

14. An air mattress according to claim 13 further including a foot pillow section which is independently inflatable relative to the head pillow section for vertically adjusting the foot level relative to said head section, and valve means for said foot pillow section.

15. A combination casket and bed system comprising:

a casket base having an upper level, a lid for covering said base for burial, said lid being hinged along a longitudinal side of the upper level of the base for opening the lid to enable viewing of the corpse from one side thereof prior to burial, an air mattress for supporting the corpse, said mattress comprising a plurality of independent sections, one of which sections is inflatable for vertically raising the face of the corpse above the upper level of the base and deflatable for lowering the corpse face below the base upper level when the lid is closed preparatory to burial, and valve means for controlling the volume of to inflate and deflate said one section independently of the other sections.

16. The invention according to claim 15 wherein said mattress comprises a plurality of independent sections, each with its own valve means, and wherein a pair of opposed side sections extending longitudinally of the mattress varies the side levels of the upper torso of the corpse whereby the upper torso may be angularly tilted toward the open side edge of the casket.

17. The invention according to claim 15 wherein said mattress comprises independent head-supporting and body-supporting sections, each with its own valve means, whereby relative adjustment of said sections will raise or lower the chin of the corpse relative to its chest to cause the head to assume a natural, restful appearance relative to the remainder of the body.

18. The invention according to claim 15 wherein said mattress comprises a plurality of independent sections, each with its own valve means, for relatively varying the head and foot levels and for relatively varying the side levels of the upper torso of the corpse to enable angular tilting of the corpse toward a viewing side of the casket, and a valve manifold for all of said valve means.

* * * * *